US005225067A

United States Patent [19]

Sagiyama et al.

[11] Patent Number: 5,225,067

[45] Date of Patent: Jul. 6, 1993

[54] METHOD FOR MANUFACTURING IRON-ZINC ALLOY PLATED STEEL SHEET HAVING TWO PLATING LAYERS AND EXCELLENT IN ELECTROPAINTABILITY AND PRESS-FORMABILITY

[75] Inventors: Masaru Sagiyama; Masaki Abe; Akira Hiraya; Junichi Inagaki; Masaya Morita, all of Tokyo, Japan

[73] Assignee: NKK Corporation, Tokyo, Japan

[21] Appl. No.: 781,388

[22] Filed: Oct. 23, 1991

[30] Foreign Application Priority Data

Nov. 30, 1990 [JP] Japan ..... 2-338836

[51] Int. Cl.[5] ..... C25D 7/06

[52] U.S. Cl. ..... 205/152; 205/155

[58] Field of Search ..... 205/152, 155

[56] References Cited

U.S. PATENT DOCUMENTS

| | | |
|---|---|---|
| 4,491,623 | 1/1985 | Kokubo et al. . |
| 4,510,209 | 4/1985 | Hada et al. . |
| 4,629,659 | 12/1986 | Kyono et al. . |
| 4,818,632 | 4/1989 | Hsu et al. . |
| 4,839,241 | 6/1989 | Abe et al. . |
| 4,908,279 | 3/1990 | Yusuke et al. . |

FOREIGN PATENT DOCUMENTS

| | | |
|---|---|---|
| 58-15554 | 3/1983 | Japan . |
| 63-243295 | 10/1988 | Japan . |
| 2-66148 | 3/1990 | Japan . |
| 2-85393 | 3/1990 | Japan . |

OTHER PUBLICATIONS

Patent Abstracts of Japan, unexamined applications, C field, vol. 14, No. 246, May 25, 1990, The Patent Office Japanese Government, p. 78 C 722-Kokai-No. 2-66 148, Japan.

Patent Abstracts of Japan, unexamined applications, C field, vol. 6, No. 208, Oct. 20, 1982, The Patent Office Japanese Government, p. 70 C 130-Kokai-No. 57-114 695, Japan.

Patent Abstracts of Japan, unexamined applications, C field, vol. 9, No. 12, Jan. 18, 1985, The Patent Office Japanese Government, p. 61 C 261-Kokai-No. 59-162 294, Japan.

Patent Abstracts of Japan, unexamined applications, C field, vol. 12, No. 128, Apr. 20, 1988, The Patent Office Japanese Government, p. 78 C 489-Kokai-No. 62-247 097, Japan.

Patent Abstracts of Japan, unexamined applications, C field, vol. 14, No. 280, Jun. 18, 1990, The Patent Office Japanese Government, p. 112 C 729, of JP-A-2-85393.

*Primary Examiner*—T. M. Tufariello

*Attorney, Agent, or Firm*—Frishauf, Holtz, Goodman & Woodward

[57] ABSTRACT

A method for manufacturing an iron-zinc alloy plated steel sheet having two plating layers and excellent in electropaintability and press-formability, which comprises the steps of: passing a steel sheet through a zinc dip-plating bath to form a zinc dip-plating layer on at least one surface of the steel sheet; then, heating the steel sheet, on which the zinc dip-plating layer has been formed, to alloy the zinc dip-plating layer and the surface portion of the steel sheet, so as to form, on the surface thereof, an alloying-treated iron-zinc alloy dip-plating layer as a lower layer having a plating weight of from 30 to 120 g/m$^2$ per surface of the steel sheet; then, passing the steel sheet through an acidic plating bath for 1 to 5 seconds without electrifying same to dissolve the surface portion of the alloying-treated iron-zinc alloy dip-plating layer, so as to form numerous fine jogs on the surface thereof; and then, electroplating the steel sheet in an iron alloy acidic electroplating bath to form an iron alloy electroplating layer as an upper layer, having a plating weight of 1 to 10 g/m$^2$ per surface of the steel sheet, on the alloying-treated iron-zinc alloy dip-plating layer as the lower layer having the numerous fine jogs.

3 Claims, 2 Drawing Sheets

METHOD FOR MANUFACTURING IRON-ZINC ALLOY PLATED STEEL SHEET HAVING TWO PLATING LAYERS AND EXCELLENT IN ELECTROPAINTABILITY AND PRESS-FORMABILITY

REFERENCE TO PATENTS, APPLICATIONS AND PUBLICATIONS PERTINENT TO THE INVENTION

As far as we known, there are available the following prior art documents pertinent to the present invention:

(1) Japanese Patent Publication No. 58-15,554 dated Mar. 26, 1983;

(2) Japanese Patent Provisional Publication No. 2-66,148 dated Mar. 6, 1990; and (3) Japanese Patent Provisional Publication No. 2-85,393 dated Mar. 26, 1990.

The contents of the prior art disclosed in the above-mentioned prior art documents will be discussed hereafter under the heating of the "BACKGROUND OF THE INVENTION".

BACKGROUND OF THE INVENTION

1. Field of the Invention

The present invention relates to a method for manufacturing an iron-zinc alloy plated steel sheet having two plating layers and excellent in electro-paintability and press-formability.

2. Related Art Statement

An iron-zinc alloy plated steel sheet has many advantages such as excellent corrosion resistance and electropaintability and a low manufacturing cost, so that the iron-zinc alloy plated steel sheet is widely used as a steel for an automobile body. There is a strong demand for the improvement of electropaintability and press-formability of such an ircn-zinc alloy plated steel sheet.

A paint film is formed on the surface of an iron-zinc alloy plated steel sheet usually as follows: Subjecting the iron-zinc alloy plated steel sheet to a phosphating treatment to form a phosphate film on the surface of the iron-zinc alloy plating layer, and then subjecting same to a cation-type electropainting treatment to form a paint film having a prescribed thickness on the phosphate film.

However, when forming the paint film on the phosphate film on the surface of the iron-zinc alloy plating layer by means of the cation-type electropainting treatment, a hydrogen gas produced during the electropainting treatment and entangled into the paint film causes the production of crater-shaped pinholes in the paint film. The thus electropainted iron-zinc alloy plated steel sheet is further subjected to a finish painting to form a finish paint film on the above-mentioned paint film. The above-mentioned crater-shaped pinholes exert an adverse effect even on the finish paint film, thus degrading the quality of the electropainted iron-zinc alloy plated steel sheet.

As an iron-zinc alloy plated steel sheet solving the above-mentioned problem, Japanese Patent Publication No. 58-15,554 dated Mar. 26, 1983 discloses an iron-zinc alloy plated steel sheet having two plating layers, suitable for a cation-type electropainting, which comprises:

a steel sheet; an iron-zinc alloy plating layer as a lower layer formed on at least one surface of said steel sheet, the zinc content in said iron-zinc alloy plating layer as the lower layer being over 40 wt. % relative to said iron-zinc alloy plating layer as the lower layer; and an iron-zinc alloy plating layer as an upper layer formed on said iron-zinc alloy plating layer as the lower layer, the zinc content in said iron-zinc alloy plating layer as the upper layer being up to 40 wt. % relative to said iron-zinc alloy plating layer as the upper layer (hereinafter referred to as the "prior art 1").

On the other hand, the iron-zinc alloy plated steel sheet for an automobile body is subjected to a severe press-forming. The severe press-forming applied to the iron-zinc alloy plated steel sheet causes a powdery peeloff of the iron-zinc alloy plating layer, known as the "powdering" and a flaky peeloff of the iron-zinc alloy plating layer, known as the "flaking".

As an iron-zinc alloy plated steel sheet solving the above-mentioned problem, Japanese Patent Provisional Publication No. 2-66,148 dated Mar. 6, 1990 discloses an iron-zinc alloy plated steel sheet having two plating layers and excellent in powdering resistance and flaking resistance, which comprises:

a steel sheet; an iron-zinc alloy plating layer as a lower layer formed on at least one surface of said steel sheet, the iron content in said iron-zinc alloy plating layer as the lower layer being up to 12 wt. % relative to said iron-zinc alloy plating layer as the lower layer; and an iron-zinc alloy plating layer as an upper layer formed on said iron-zinc alloy plating layer as the lower layer, the iron content in said iron-zinc alloy plating layer as the upper layer being at least 50 wt. % relative to said iron-zinc alloy plating layer as the upper layer, and the frictional coefficient of said iron-zinc alloy plating layer as the upper layer being up to 0.22 (hereinafter referred to as the "prior art 2").

Furthermore, as an iron alloy plated steel sheet solving the above-mentioned problems of the crater-shaped pinholes, the powdering and the flaking, Japanese Patent Provisional Publication No. 2-85,393 dated Mar. 26, 1990 discloses an iron alloy plated steel sheet having two plating layers and excellent in cratering resistance, powdering resistance and flaking resistance, which comprises:

a steel sheet; an iron-zinc alloy plating layer or a nickel-zinc alloy plating layer as a lower layer formed on at least one surface of said steel sheet, the iron content in said iron-zinc alloy plating layer as the lower layer being within a range of from 10 to 20 wt. % relative to said iron-zinc alloy plating layer as the lower layer, and the nickel content in said nickel-zinc alloy plating layer as the lower layer being within a range of from 8 to 14 wt. % relative to said nickel-zinc alloy plating layer as the lower layer; and an iron-phosphorus alloy plating layer as an upper layer formed on said iron-zinc alloy plating layer or said nickel-iron alloy plating layer as the lower layer, the phosphorus content in said iron-phosphorus alloy plating layer as the upper layer being within a range of from 0.003 to 0.500 wt. % relative to said iron-phosphorus alloy plating layer as the upper layer (hereinafter referred to as the "prior art 3").

According to the prior art 1, it is possible to prevent the production of the crater-shaped pinholes in the paint film; according to the prior art 2, it is possible to prevent the occurrence of the powdering and the flaking of the iron-zinc alloy plating layer during the press-forming; and according to the prior art 3, it is possible to prevent the production of the crater-shaped pinholes in the paint film and the occurrence of the powdering and the flaking of the iron-zinc alloy plating layer during the press-forming In an iron alloy plated steel sheet having two plating layers such as that in the prior art 1, 2 or 3, it is the usual practice to form the lower layer with an alloying-treated iron-zinc alloy dip-plating layer having a relatively large plating weight, and the upper layer with an iron alloy electroplating layer having a relatively small plating weight with a view to economically improving corrosion resistance of the iron alloy plated steel sheet.

However, the prior arts 1 to 3 have the following problems: Application of a severe press-forming to the iron alloy plated steel sheet of the prior art 1, 2 or 3 causes the production of cracks or peeloffs in the alloying-treated iron-zinc alloy dip-plating layer as the lower layer and the iron alloy electroplating layer as the upper layer.

When applying a phosphating treatment to the iron-zinc alloy plated steel sheet, in which the above-mentioned cracks or peeloffs have been produced in the plating layers, to form a phosphate film on the surface of the iron-zinc alloy electroplating layer as the upper layer, the steel sheet exposed by the cracks or the peeloffs accelerates dissolution of the lower and the upper plating layers into the phosphating solution. As a result, phosphate crystal grains of the phosphate film grow in an abnormally large amount even on the inner surfaces of the cracks or the peeloffs of the plating layers.

When the paint film is baked after the electropainting thereof, therefore, a large amount of crystal water is released from the phosphate crystal grains of the phosphate film. The crystal water released is entangled in the paint film and vaporized to produce bubbles in the paint film. Production of the bubbles in the paint film is considered to be rather accelerated by the iron alloy electroplating layer as the upper layer. Production of these bubbles exerts an adverse effect even on the finish paint film, thus deteriorating the quality of the painted iron-zinc alloy plated steel sheet.

Under such circumstances, there is a demand for the development of a method for manufacturing an iron-zinc alloy plated steel sheet having two plating layers and excellent in electropaintability and press-formability, in which such defects as bubbles and pinholes are not produced in the paint film even when subjected to a severe press-forming, but a method for manufacturing an iron-zinc alloy plated steel sheet provided with such properties as described above has not as yet been proposed.

SUMMARY OF THE INVENTION

An object of the present invention is therefore to provide a method for manufacturing an iron-zinc alloy plated steel sheet having two plating layers and excellent in electropaintability and press-formability, in which such defects as bubbles and pinholes are not produced in the paint film even when subjected to a severe press-forming.

In accordance with one of the features of the present invention, there is provided a method for manufacturing an iron-zinc alloy plated steel sheet having two plating layers and excellent in electropaintability and press-formability, which comprises the steps of:

passing a steel sheet through a zinc dip-plating bath to apply a zinc dip-plating treatment to said steel sheet, so as to form a zinc dip-plating layer on at least one surface of said steel sheet; then heating said steel sheet, on which said zinc dip-plating layer has been formed, to apply an alloying treatment to said zinc dip-plating layer and the surface portion of said steel sheet, so as to form, on at least one surface of said steel sheet, an alloying-treated iron-zinc alloy dip-plating layer as a lower layer, which has a plating weight within a range of from 30 to 120 g/m$^2$ per surface of said steel sheet; then passing said steel sheet, on which said alloying-treated iron-zinc alloy dip-plating layer as the lower layer has been formed, through an acidic plating bath for a period of time of from 1 to 5 seconds without electrifying same to dissolve the surface portion of said alloying-treated iron-zinc alloy dip-plating layer as the lower layer in said acidic plating bath, so as to form numerous fine jogs on the surface of said alloying-treated iron-zinc alloy dip-plating layer as the lower layer; and then electroplating said steel sheet, on which said alloying-treated iron-zinc alloy dip-plating layer as the lower layer having said numerous fine jogs has been formed, in an iron alloy acidic electroplating bath to form an iron alloy electroplating layer as an upper layer, having a plating weight within a range of from 1 to 10 g/m$^2$ per surface of said steel sheet, on said alloying-treated iron-zinc alloy dip-plating layer as the lower layer.

DETAILED DESCRIPTION OF PREFERRED EMBODIMENTS

Figure 1:
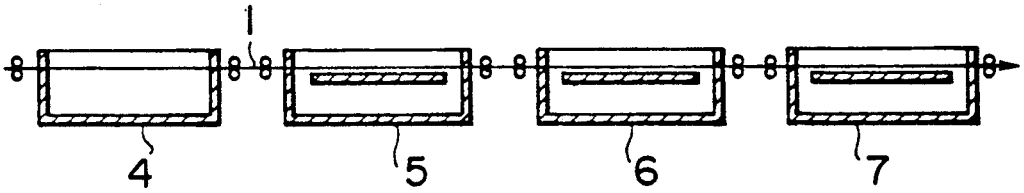
FIG. 1 is a schematic flow diagram illustrating an embodiment of the method of the present invention.

From the above-mentioned point of view, extensive studies were carried out to develop a method for manufacturing an iron-zinc alloy plated steel sheet having two plating layers and excellent in electropaintability and press-formability, in which such defects as bubbles and pinholes are not produced in the paint film even when subjected to a severe press-forming.

When applying a severe press-forming to an iron-zinc alloy plated steel sheet having two plating layers, which comprises an alloying-treated iron-zinc alloy dip-plating layer as a lower layer formed on at least one surface of a steel sheet and an iron-zinc alloy electroplating layer as an upper layer formed on the iron-zinc dip-plating layer as the lower layer, then subjecting same to a phosphating treatment to form a phosphate film on the surface of the iron-zinc alloy electroplating layer as the upper layer, and then subjecting same to an electropainting treatment to form a paint film on the phosphate film, bubbles are easily produced in the paint film. Causes of this phenomenon were first investigated. As a result, the followings were made clear.

The iron-zinc alloy electroplating layer as the upper layer, which is formed through the electroprecipitation of metals, has a considerable inner stress therein. On the other hand, the alloying-treated iron-zinc alloy dip-plating layer as the lower layer has almost no inner stress therein. Consequently, the iron-zinc alloy electroplating layer as the upper layer locally and strongly restrains the alloying-treated iron-zinc alloy dip-plating layer as the lower layer. When applying a severe press-forming to the iron-zinc alloy plated steel sheet having these two plating layers, therefore, cracks or peeloffs tend to be locally produced in the alloying-treated iron-zinc alloy dip-plating layer as the lower layer. As a result, bubbles are produced in the paint film resulting from the vaporization of crystal water released from the phosphate crystal grains of the phosphate film, as described above.

In addition, a detailed investigation was carried out on the relationship between the production of bubbles in the paint film and the large cracks or peeloffs in the plating layer. This investigation demonstrated that the local large cracks or peeloffs were not produced in the alloying-treated iron-zinc alloy dip-plating layer as the lower layer of the electroplated iron-zinc alloy plated steel sheet, in which bubbles were not produced in the paint film, but instead, numerous fine cracks were uniformly produced overall the above-mentioned plating layer as the lower layer.

From these investigations, the following findings were obtained: By passing the steel sheet, on which the alloying-treated iron-zinc alloy dip-plating layer as the lower layer has been formed, through an acidic plating bath for a prescribed period of time without electrifying same, prior to the electroplating, to dissolve the surface portion of the alloying-treated iron-zinc alloy dip-plating layer as the lower layer so as to form numerous fine jogs on the surface of the alloying-treated iron-zinc alloy dip-plating layer as the lower layer, it is possible to cause dispersion of the inner stress in the iron-zinc alloy electroplating layer as the upper layer and thus to reduce the restraining force acting on the alloying-treated iron-zinc alloy dip-plating layer as the lower layer. As a result, large cracks or peeloffs are not produced in the alloying-treated iron-zinc alloy dip-plating layer as the lower layer even when applying a severe press-forming to the iron-zinc alloy plated steel sheet having the two plating layers. Consequently, bubbles are never produced in the paint film formed on the surface of the iron-zinc alloy electroplating layer as the upper layer.

The present invention was made on the basis of the above-mentioned findings. The method of the present invention for manufacturing the iron-zinc alloy plated steel sheet having two plating layers and excellent in electropaintability and press-formability, is described below with reference to the drawings.

Figures 2A, 2B, 2C:
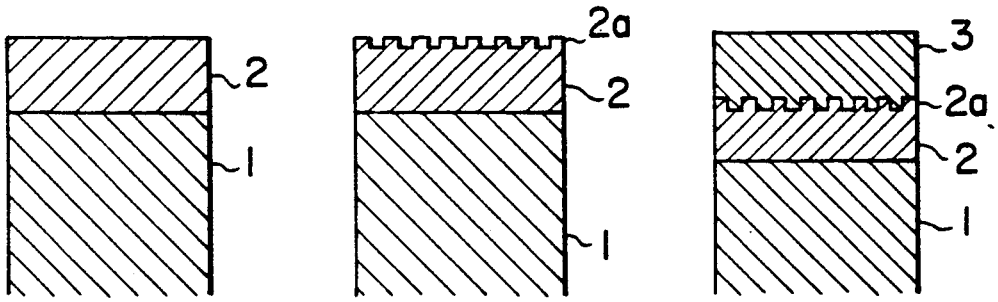
FIG. 2(A) is a schematic descriptive view illustrating a step for forming an alloying-treated iron-zinc alloy dip-plating layer as a lower layer on the surface of a steel sheet in accordance with the method of the present invention.
FIG. 2(B) is a schematic descriptive view illustrating a step for forming numerous fine jogs on the surface of the alloying-treated iron-zinc alloy dip-plating layer as the lower layer in accordance with the method of the present invention.
FIG. 2(C) is a schematic descriptive view illustrating a step for forming an iron alloy electroplating layer as an upper layer on the alloying-treated iron-zinc alloy dip-plating layer as the lower layer having the numerous fine jogs in accordance with the method of the present invention.

FIG. 1 is a schematic flow diagram illustrating an embodiment of the method of the present invention, and FIGS. 2(A) to 2(C) are schematic descriptive views illustrating the steps in the embodiment of the method of the present invention.

A steel sheet 1 is passed through a zinc dip-plating bath not shown to subject the steel sheet to a zinc dip-plating treatment so as to form a zinc dip-plating layer on at least one surface of the steel sheet 1. Then, the steel sheet 1, on which the zinc dip-plating layer has been formed, is heated by means of an alloying apparatus not shown to apply an alloying treatment to the zinc dip-plating layer and the surface portion of the steel sheet 1, so as to convert the zinc dip-plating layer into an alloying-treated iron-zinc alloy dip-plating layer 2 as shown in the schematic descriptive view of FIG. 2(A). The alloying-treated iron-zinc alloy dip-plating layer 2 as a lower layer is thus formed on at least one surface of the steel sheet 1.

Then, the steel sheet 1, on which the alloying-treated iron-zinc alloy dip-plating layer 2 as the lower layer has been formed, is passed through a plating tank 4 containing an acidic plating bath for a prescribed period of time without electrifying same, as shown in FIG. 1. As a result, a base zinc-rich phase in the surface portion of the alloying-treated iron-zinc alloy dip-plating layer 2 as the lower layer is preferentially dissolved in the plating tank 4, thus forming numerous fine jogs 2*a* on the surface of the alloying-treated iron-zinc alloy dip-plating layer 2 as the lower layer, as shown in FIG. 2(B).

Then, the steel sheet, on which the alloying-treated iron-zinc alloy dip-plating layer 2 as the lower layer having the numerous fine jogs 2*a* has been formed, is passed sequentially through a plurality of electroplating tanks 5, 6 and 7, which contain any one of iron alloy acidic electroplating baths such as an iron-zinc alloy electroplating bath, an iron-phosphorus alloy electroplating bath and an iron-boron alloy electroplating bath, to electroplate the steel sheet 1 in the electroplating tanks 5 to 7. As a result, an iron alloy electroplating layer 3 as an upper layer such as an iron-zinc alloy electroplating layer, an iron-phosphorus alloy electroplating layer or an iron-boron alloy electroplating layer is formed on the alloying-treated iron-zinc alloy dip-plating layer 2 as the lower layer having the numerous fine jogs 2*a*, as shown in FIG. 2(C).

When the iron-zinc alloy plated steel sheet having the two plating layers formed as described above is subjected to a severe press-forming, numerous fine cracks are uniformly produced in the alloying-treated iron-zinc dip-plating layer 2 as the lower layer starting from the numerous fine jogs 2*a* formed on the surface of the alloying-treated iron-zinc alloy dip-plating layer 2 as the lower layer. It is therefore possible to prevent the production of bubbles in the paint film when forming the paint film by means of the electropainting on the surface of the iron-zinc alloy plated steel sheet.

As described above, when the inner stress present in the iron alloy electroplating layer 3 as the upper layer locally and strongly restrains the alloying-treated iron-zinc alloy dip-plating layer 2 as the lower layer, to cause a stress to act on the alloying-treated iron-zinc alloy dip-plating layer 2 as the lower layer during the press-forming, considerable cracks and peeloffs are produced in the alloying-treated iron-zinc alloy dip-plating layer 2 as the lower layer, thus destroying the plating layers of the iron-zinc alloy plated steel sheet. This conventional problem is overcome by the iron-zinc alloy plated steel sheet manufactured in accordance with the method of the present invention.

Formation of the zinc dip-plating layer on at least one surface of the steel sheet 1 may be accomplished by using a conventional zinc dip-plating bath and under conventional zinc dip-plating conditions. Then, when forming the alloying-treated iron-zinc alloy dip-plating layer 2 as the lower layer on at least one surface of the steel sheet 1 as described above, the zinc dip-plating layer and the surface portion of the steel sheet are alloyed by heating the zinc-plated steel sheet 1 to a temperature within a range of from 470° to 520° C.

When the plating weight of the alloying-treated iron-zinc alloy dip-plating layer 2 as the lower layer is under 30 g/m$^2$ per surface of the steel sheet 1, corrosion resistance of the iron-zinc alloy plated steel sheet is degraded. When the plating weight of the alloying-treated iron-zinc alloy dip-plating layer 2 as the lower layer is over 120 g/m$^2$ per surface of the steel sheet 1, on the other hand, press-formability of the iron-zinc alloy plated steel sheet is degraded. The plating weight of the alloying-treated iron-zinc alloy dip-plating layer 2 as the lower layer should therefore be limited within a range of from 30 to 120 g/m$^2$.

When the iron content in the alloying-treated iron-zinc alloy dip-plating layer 2 as the lower layer is under 7 wt. %, corrosion resistance of the iron-zinc alloy plated steel sheet is degraded. When the iron content in the alloying-treated iron-zinc alloy dip-plating layer 2 as the lower layer is over 15 wt. %, on the other hand, press-formability of the iron-zinc alloy plated steel sheet is degraded. The iron content in the alloying-treated iron-zinc alloy dip-plating layer 2 as the lower layer should therefore be limited within a range of from 7 to 15 wt. %.

When the period of time of passing the steel sheet 1, on which the alloying-treated iron-zinc alloy dip-plating layer 2 as the lower layer has been formed, through the acidic plating bath without electrifying same, is under one second, it is impossible to cause the zinc-rich phase to dissolve preferentially to form the numerous fine jogs 2*a* on the surface of the alloying-treated iron-zinc alloy dip-plating layer 2 as the lower layer, thus making it impossible to prevent the production of cracks and peeloffs in the plating layer during the press-forming. When the period of time of passing the steel sheet 1, on which the alloying-treated iron-zinc alloy dip-plating layer 2 as the lower layer has been formed, through the acidic plating bath without electrifying same, is over five seconds, on the other hand, the alloying-treated iron-zinc alloy dip-plating layer 2 as the lower layer is excessively dissolved, thus causing the degradation of corrosion resistance of the iron-zinc alloy plated steel sheet. The period of time of passing the steel sheet 1, on which the alloying-treated iron-zinc alloy dip-plating layer 2 as the lower layer has been formed, through the acidic plating bath without electrifying same, should therefore be limited within a range of from 1 to 5 seconds.

As the above-mentioned acidic plating bath, a conventional acidic plating bath, or an iron alloy acidic electroplating baths received in the plurality of electroplating tanks 5 to 7 for forming the iron alloy electroplating layer 3 as the upper layer, may be used. It suffices for the temperature of the acidic plating bath to be within a range of from 40° to 70° C. as in the conventional practice.

Formation of the iron-zinc alloy electroplating layer, the iron-phosphorus alloy electroplating layer or the iron-boron alloy electroplating layer as the upper layer on the surface of the steel sheet 1, on which the alloying-treated iron-zinc alloy dip-plating layer 2 as the lower layer having the numerous fine jogs 2*a* has been formed, may be accomplished by using a conventional iron alloy acidic electroplating bath comprising any one of an iron-zinc alloy, an iron-phosphorus alloy and an iron-boron alloy under conventional electroplating conditions.

An iron-zinc alloy plating layer containing up to 50 wt. % zinc, an iron-phosphorus alloy plating layer containing from 0.0003 to 15 wt. % phosphorus, an iron-boron alloy plating layer containing from 0.003 to 3 wt. % boron, or an iron alloy plating layer which contains over 50 wt. % iron and at least two elements selected from the group consisting of zinc, phosphorus and boron in amounts within the respective ranges as described above, is suitable as the iron alloy electroplating layer 3 as the upper layer.

When the plating weight of the iron alloy electroplating layer 3 as the upper layer is under 1 g/m$^2$ per surface of the steel sheet 1, a hydrogen gas produced during the electroplating treatment and entangled into the paint film causes a easy production of crater-shaped pinholes in the paint film, thus degrading electropaintability of the iron-zinc alloy electroplated steel sheet. When the plating weight of the iron alloy electroplating layer 3 as the upper layer is over 10 g/m$^2$ per surface of the steel sheet 1, on the other hand, press-formability of the iron-zinc alloy plated steel sheet is degraded. The plating weight of the iron alloy electroplating layer 3 as the upper layer should therefore be limited within a range of from 1 to 10 g/m$^2$.

Now, the method of the present invention for manufacturing the iron-zinc alloy plated steel sheet having two plating layers and excellent in electropaintability and press-formability, is described below further in detail by means of examples while comparing with examples for comparison.

EXAMPLES

The both surfaces of a cold-rolled steel sheet having a thickness of 0.8 mm were cleaned by means of a usual alkali degreasing and a usual electrolytic pickling. Then, the thus cleaned cold-rolled steel sheet was subjected to a zinc dip-plating treatment and then to an alloying treatment under the following conditions to form, as shown in FIG. 2(A), an alloying-treated iron-zinc alloy dip-plating layer 2 as a lower layer on each of the both surfaces of the cold-rolled steel sheet 1:

(1) Chemical composition of plating bath: Aluminum: 0.12 wt. %, and
(2) Plating bath temperature: 460° C.,
(3) Temperature of steel sheet passing through the plating bath: 470° C.,
(4) Alloying treatment temperature: 510° C.,
(5) Alloying treatment time: adjusted so that the plating layer has a prescribed iron content.

Then, as shown in FIG. 1, the steel sheet 1, having the alloying-treated iron-zinc alloy dip-plating layer 2 as the lower layer on each of the both surfaces thereof, was passed through a plating tank 4 containing an acidic plating bath without electrifying same under the following conditions, to dissolve a base zinc-iron phase in the surface portion of the alloying-treated iron-zinc alloy dip-plating layer 2 as the lower layer in the plating tank 4, thereby forming numerous fine jogs 2*a* on the surface of the alloying-treated iron-zinc alloy dip-plating layer 2 as the lower layer, as shown in FIG. 2(B):

(1) Chemical composition of plating bath: $FeSO_4.7H_2O$: 380 g/l, and $ZnSO_4.7H_2O$: 20 g/l,
(2) Plating bath temperature: 50° C.,
(3) Passing time: 2 seconds.

Then, as shown in FIG. 1, the steel sheet 1, on which the alloying-treated iron-zinc alloy dip-plating layer 2 as the lower layer having the numerous fine jogs 2*a* had been formed, was passed sequentially through a first electroplating tank 5, a second electroplating tank 6 and a third electroplating tank 7 to electroplate same under the following conditions:

(1) Chemical composition of plating bath: $FeSO_4.7H_2O$: 380 g/l, and $ZnSO_4.7H_2O$: 20 g/l,
(2) pH of plating bath: 1.8 to 2.0,
(3) Plating bath temperature: 50° C.,
(4) Plating electric current density: First electroplating tank 5: 50 A/dm$^2$, Second electroplating tank 6: 50 A/dm$^2$, Third electroplating tank 7: 50 A/dm$^2$.

Thus, as shown in FIG. 2(C), an iron-zinc alloy electroplating layer 3 as an upper layer was formed on the alloying-treated iron-zinc alloy dip-plating layer 2 as the lower layer having the numerous fine jogs 2*a*. There was thus prepared, as shown in Table 1, a sample of the iron-zinc alloy plated steel sheet having the two plating layers within the scope of the present invention (hereinafter referred to as the "sample of the invention") No. 1.

Then, as shown in FIG. 1, another steel sheet 1, on which an alloying-treated iron-zinc alloy dip-plating layer 2 as a lower layer having numerous fine jogs 2*a* had been formed under the same plating conditions as in the sample of the invention No. 1, was passed sequentially through a first electroplating tank 5, a second electroplating tank 6 and a third electroplating tank 7 to electroplate same under the following conditions:

(1) Chemical composition of plating bath: $FeCl_2$: 150 g/l, KCl: 200 g/l, citric acid: 10 g/l, and $NaH_2PO_2$: 2 g/l,
(2) pH of plating bath: 3.0,
(3) Plating bath temperature: 50° C.,
(4) Plating electric current density: First electroplating tank 5: 30 A/dm$^2$, Second electroplating tank 6: 30 A/dm$^2$, Third electroplating tank 7: 30 A/dm$^2$.

Thus, as shown in FIG. 2(C), an iron-phosphorus alloy electroplating layer 3 as an upper layer was formed on the alloying-treated iron-zinc alloy dip-plating layer 2 as the lower layer having the numerous fine jogs 2*a*. There was thus prepared, as shown in Table 1, a sample of the iron-zinc alloy plated steel sheet having the two plating layers within the scope of the present invention (hereinafter referred to as the "sample of the invention") No. 2.

Then, as shown in FIG. 1, further another steel sheet 1, on which an alloying-treated iron-zinc alloy dip-plating layer 2 as a lower layer having numerous fine jogs 2*a* had been formed under the same plating conditions as in the sample of the invention No. 1, was passed sequentially through a first electroplating tank 5, a second electroplating tank 6 and a third electroplating tank 7 to electroplate same under the following conditions:

(1) Chemical composition of plating bath: $FeSO_4.7H_2O$: 380 g/l, and boric acid: 20 g/l,
(2) pH of plating bath: 2.0,
(3) Plating bath temperature: 50° C.,
(4) Plating electric current density: First electroplating tank 5: 50 A/dm$^2$, Second electroplating tank 6: 50 A/dm$^2$, Third electroplating tank 7: 50 A/dm$^2$.

Thus, as shown in FIG. 2(C), an iron-boron alloy electroplating layer 3 as an upper layer was formed on the alloying-treated iron-zinc alloy dip-plating layer 2 as the lower layer having the numerous fine jogs 2*a*. There was thus prepared, as shown in Table 1, a sample of the iron-zinc alloy plated steel sheet having the two plating layers within the scope of the present invention (hereinafter referred to as the "sample of the invention") No. 3.

Then, for comparison purposes, a cold-rolled steel sheet 1, in which an alloying-treated iron-zinc alloy dip-plating layer 2 as a lower layer had been formed on each of the both surfaces of the steel sheet 1 under the same conditions as in the sample of the invention No. 1, was directly passed, as shown in FIG. 1, sequentially through a first electroplating tank 5, a second electroplating tank 6 and a third electroplating tank 7, without passing the steel sheet 1 through a plating tank 4 in which an plating electric current was not applied, to electroplate the steel sheet 1 under the following conditions:

(1) Chemical composition of plating bath: $FeSO_4.7H_2O$: 380 g/l, and $ZnSO_4.7H_2O$: 20 g/l,
(2) pH of plating bath: 1.8 to 2.0,
(3) Plating bath temperature: 50° C.,
(4) Plating electric current density: First electroplating tank 5: 50 A/dm$^2$, Second electroplating tank 6: 50 A/dm$^2$, Third electroplating tank 7: 50 A/dm$^2$.

An iron-zinc alloy electroplating layer as an upper layer was thus formed on the alloying-treated iron-zinc alloy dip-plating layer 2 as the lower layer. There was thus prepared, as shown in Table 1, a sample of the iron-zinc alloy plated steel sheet having the two plating layers outside the scope of the present invention (hereinafter referred to as the "sample for comparison") No. 1.

Then, for comparison purposes, an alloying-treated iron-zinc alloy dip-plating layer 2 as a lower layer was formed on each of the both surfaces of another cold-rolled steel sheet 1 under the same plating conditions as in the sample of the invention No. 1, and then, an iron-zinc alloy electroplating layer as an upper layer was formed on the alloying-treated iron-zinc alloy dip-plating layer 2 as the lower layer under the same plating conditions as in the sample of the invention No. 1, except that the steel sheet 1, having the alloying-treated iron-zinc alloy dip-plating layer 2 as the lower layer 2, was passed through a plating tank 4 containing an acidic plating bath without electrifying same under the following conditions:

(1) Chemical composition of plating bath: $FeSO_4.7H_2O$: 380 g/l, and $ZnSO_4.7H_2O$: 20 g/l,
(2) Plating bath temperature: 50° C.,
(3) Passing time: 0.8 seconds.

There was thus prepared, as shown in Table 1, a sample of the iron-zinc alloy plated steel sheet having the two plating layers outside the scope of the present invention (hereinafter referred to as the "sample for comparison") No. 2.

TABLE 1

| No. | | Alloying-treated Fe-Zn alloy dip-plating layer (lower layer) Chemical composition (wt. %) Fe | Zn | Plating weight ($g/m^2$) | Time of passing through plating bath without electrifying (sec.) | Iron alloy electro-plating layer (lower layer) Chemical composition (wt. %) Fe | Zn | P | B | Plating weight ($g/m^2$) | Electro-paintability: Production of bubbles | Production of crater-shaped pinholes | Press-formability |
|---|---|---|---|---|---|---|---|---|---|---|---|---|---|
| Sample | 1 | 10.5 | 89.5 | 65 | 2 | 85 | 15 | — | — | 6 | ○ | ○ | 3.2 |
| of the | 2 | 10.5 | 89.5 | 65 | 2 | 98 | — | 2 | — | 4 | ○ | ○ | 3.1 |
| invention | 3 | 10.5 | 89.5 | 45 | 2 | 99.8 | — | — | 0.2 | 6 | ○ | ○ | 2.1 |
| Sample for | 1 | 10.7 | 89.3 | 67 | — | 85 | 15 | — | — | 6 | X | ○ | 7.5 |
| comparison | 2 | 10.5 | 89.5 | 65 | 0.8 | 85 | 15 | — | — | 6 | X | ○ | 6.4 |

For each of the samples of the invention Nos. 1 to 3 and the samples for comparison Nos. 1 and 2 prepared as described above, electropaintability and press-formability were investigated through the following performance tests. The results of these tests are shown also in Table 1.

(1) Electropaintability test:

(a) Production of bubbles in paint film:

Each sample was subjected to an immersion-type phosphating treatment in a phosphating solution to form a phosphate film on each of the both surfaces of each sample, and then subjected to a cation-type electropainting treatment to form a paint film having a thickness of 20 μm on the phosphate film under the following conditions:

Impressed voltage: 260 V,
Paint temperature: 27° C.,
Ratio of sample surface/anode surface: 1/1,
Baking temperature: 270° C., and
Baking time: 10 minutes.

Production of bubbles in the paint film thus formed on each sample was investigated through the visual inspection, and was evaluated in accordance with the following criteria:

○: No bubbles are produced in the paint film;
Δ: One to ten bubbles are produced in the paint film;
X: Over ten bubbles are produced in the paint film.

(b) Production of crater-shaped pinholes in paint film:

Each sample was subjected to an immersion-type phosphating treatment in a phosphating solution to form a phosphate film on each of the both surfaces of each sample, and then subjected to a cation-type electropainting treatment to form a paint film having a thickness of 20 μm on the phosphate film under the following conditions:

Impressed voltage: 280 V,
Paint temperature: 27° C.,
Ratio of sample surface/anode surface: 1/1,
Baking temperature: 170° C.,
Baking time: 25 minutes.

Production of crater-shaped pinholes in the paint film thus formed on each sample was investigated through the visual inspection, and was evaluated in accordance with the following criteria:

○: Up to 20 crater-shaped pinholes are produced in the paint film;
Δ: From over 20 to up to 100 crater-shaped pinholes are produced in the paint film;
X: Over 100 crater-shaped pinholes are produced in the paint film.

Figure 3:
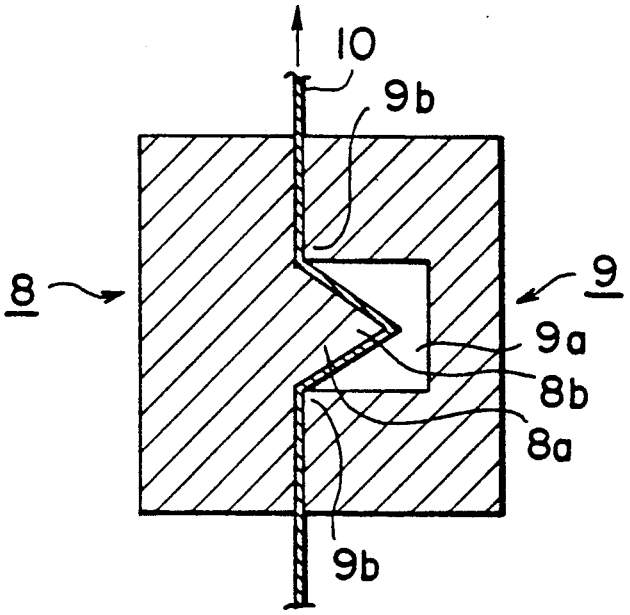
FIG. 3 is a schematic vertical sectional view illustrating a draw-bead tester for testing press-formability of an iron-zinc alloy plated steel sheet.

(2) Press-formability test:

Press-formability of each sample was investigated by the use of a draw-bead tester as shown in the schematic vertical sectional view of FIG. 3.

As shown in FIG. 3, the draw-bead tester comprises a male die 8 having a substantially horizontal projection 8*a* with a prescribed height, and a female die 9 having a groove 9*a* with a prescribed depth, which groove faces the projection 8*a* of the male die 8. While the male die 8 is stationarily secured, the female die 9 is horizontally movable toward the male die 8 by means of a hydraulic cylinder not shown. A tip 8*b* of the projection 8*a* of the male die 8 has a radius of 0.5 mm. Each shoulder 9*b* of the groove 9*a* of the female die 9 has a radius of 1 mm. The projection 8*a* of the male die 8 and the groove 9*a* of the female die 9 have a width of 40 mm.

A test piece 10 (i.e., each of the samples of the invention Nos. 1 to 3 and samples for comparison Nos. 1 and 2) having a width of 30 mm was vertically inserted into the gap between the male die 8 and the female die 9 of the above-mentioned draw-bead tester, and by operating a hydraulic cylinder not shown, the test piece 10 was pressed against the projection 8*a* of the male die 8 and the shoulders 9*b* of the groove 9*a* of the female die 9 under a pressure of 500 $kgf/cm^2$. Then, the test piece 10 was pulled out upward as shown by the arrow in FIG. 3 to squeeze same. Then, an adhesive tape was stuck to the iron alloy electroplating layer as the upper layer of the thus squeezed test piece 10, and then the adhesive tape was peeled off. The amount of peeloff of the plating layer was measured and press-formability was evaluated from the thus measured amount of peeloff.

As is clear from Table 1, the sample for comparison No. 1, in which the alloying-treated iron-zinc alloy dip-plating layer as the lower layer was formed on the cold-rolled sheet under the same plating conditions as in the sample of the invention No. 1, and the above-mentioned steel sheet was then immediately electroplated under the same plating conditions as in the sample of the invention No. 1 to form the iron-zinc alloy electroplating layer as the upper layer on the alloying-treated iron-zinc alloy dip-plating layer as the lower layer, with the omission of passing through the acidic plating bath without electrifying, showed the production of only slight crater-shaped pinholes, but suffered from the production of many bubbles in the paint film, thus, resulting in a poor electropaintability. The sample for comparison No. 1 showed furthermore a large amount of peeloff of the plating layer, thus leading to a poor press-formability.

The sample for comparison No. 2, which was prepared under the same plating conditions as in the sample of the invention No. 1 except that the steel sheet, on which the alloying-treated iron-zinc alloy dip-plating layer as the lower layer had been formed, was passed through the acidic plating bath without electrifying same for such a short period of time as 0.8 seconds outside the scope of the present invention, showed the production of only slight crater-shaped pinholes, but suffered from the production of many bubbles in the paint film, thus resulting in a poor electropaintability. The sample for comparison No. 2 showed furthermore a large amount of peeloff of the plating layer, thus leading to a poor press-formability.

In contrast, as is clear from Table 1, the samples of the invention Nos. 1 to 3 showed the production of only slight crater-shaped pinholes and no production of bubbles in the paint film, thus suggesting an excellent electropaintability. The samples of the invention Nos. 1 to 3 showed furthermore a small amount of peeloff of the plating layer, thus leading to an excellent press-formability.

Accordance to the method of the present invention, as described above in detail, it is possible to provide an iron-zinc alloy plated steel sheet having two plating layers and excellent in electropaintability and press-formability, in which such defects as bubbles and pinholes are not produced in the paint film even when subjected to a severe press-forming, thus providing industrially useful effects.

What is claimed is:

1. A method for manufacturing an iron-zinc alloy plated steel sheet having two plating layers and excellent in electropaintability and press-formability, which comprises the steps of:

passing a steel sheet through a zinc dip-plating bath to apply a zinc dip-plating treatment to said steel sheet, so as to form a zinc dip-plating layer on at least one surface of said steel sheet; then heating said steel sheet, on which said zinc dip-plating layer has been formed, to apply an alloying treatment to said zinc dip-plating layer and the surface portion of said steel sheet, so as to form, on at least one surface of said steel sheet, an alloying-treated iron-zinc alloyed dip-plating layer as a lower layer, which has a plating weight within a range of from 30 to 120 g/m$^2$ per surface of said steel sheet; then passing said steel sheet, on which said alloying-treated iron-zinc alloy dip-plating layer as the lower layer has been formed, through an acidic plating bath for a period of time of from 1 to 5 seconds without electrifying same to dissolve the surface portion of said alloying-treated iron-zinc alloy dip-plating layer as the lower layer in said acidic plating bath, so as to form numerous fine jogs on the surface of said alloying-treated iron-zinc alloy dip-plating layer as the lower layer; and then electroplating said steel sheet, on which said alloying-treated iron-zinc alloy dip-plating layer as the lower layer having said numerous fine jogs has been formed, in an iron alloy acidic electroplating bath to form an iron alloy electroplating layer as an upper layer, having a plating weight within a range of from 1 to 10 g/m$^2$ per surface of said steel sheet, on said alloying-treated iron-zinc alloy dip-plating layer as the lower layer.

2. A method as claimed in claim 1, wherein:

said alloying treatment comprises the steps of:

heating said steel sheet, on which said zinc dip-plating layer has been formed, to a temperature within a range of from 470° to 520° C. to adjust the iron content in said alloying-treated iron-zinc alloy dip-plating layer as the lower layer within a range of from 7 to 15 wt. %.

3. A method as claimed in claim 1 or 2, wherein:

said iron alloy electroplating layer as the upper layer comprises any one of an iron-zinc alloy, an iron-phosphorus alloy and an iron-boron alloy.

* * * * *